US006054241A

United States Patent [19]

Yamamoto et al.

[11] Patent Number: 6,054,241

[45] Date of Patent: Apr. 25, 2000

[54] IMAGE FORMING METHOD, IMAGE FORMING DEVICE, AND ELECTROSTATIC LATENT IMAGE DEVELOPING AGENT

[75] Inventors: Yasuo Yamamoto, Minami-Ashigara; Yutaka Kanai; Taku Fukuhara, both of Ashigarakami-gun, all of Japan

[73] Assignee: Fuji Xerox Co., Ltd., Tokyo, Japan

[21] Appl. No.: 09/111,481

[22] Filed: Jul. 8, 1998

[30] Foreign Application Priority Data

Jul. 15, 1997 [JP] Japan ..... 9-190238

[51] Int. Cl.[7] ..... G03G 9/083

[52] U.S. Cl. ..... 430/106.6; 430/122; 399/270

[58] Field of Search ..... 430/106.6, 120, 430/122; 399/270

[56] References Cited

U.S. PATENT DOCUMENTS 5,357,317 10/1994 Fukuchi et al. ..... 355/208
5,750,308 5/1998 Tsujita et al. ..... 430/120

FOREIGN PATENT DOCUMENTS 2-101474 4/1990 Japan .
5-119516 5/1993 Japan .
5-173372 7/1993 Japan .

*Primary Examiner*—John Goodrow
*Attorney, Agent, or Firm*—Oliff & Berridge, PLC

[57] ABSTRACT

In image forming method comprising an exposure step of forming an electrostatic latent image and a developing step of developing the electrostatic latent image, a developer comprises a magnetic carrier and a toner; a developing curve of the developer at the time when the developer is used has a saturated characteristic, the developing curve being as expression of the relation between the amount of toner transferred to the latent image support member and contrast potential, the contrast potential being determined by the developing bias potential applied to the developer support member and the potential of an exposed portion of the latent image support member; a proportion of the toner in the developer is in a range from 5 to 10% by weight; a time constant of the developer is less than or equal to 40 msec; and the developing step comprises applying developing bias voltage to the developer support member such that an amount of the toner transferred to the latent image support member reaches a saturated range. An image forming device to which the above method is applied and an electrostatic latent image developer used in the above method and device are also provided.

14 Claims, 12 Drawing Sheets

IMAGE FORMING METHOD, IMAGE FORMING DEVICE, AND ELECTROSTATIC LATENT IMAGE DEVELOPING AGENT

BACKGROUND OF THE INVENTION

1. Field of the Invention

The present invention relates to an image forming method used in digital printers, digital copiers, and the like in which an image is treated as digital signals, and also to an image forming device and an electrostatic latent image developer. In particular, the present invention relates to an image forming method, an image forming device and an electrostatic latent image developer using a two-component developer in which a toner is mixed with a magnetic carrier.

2. Description of the Related Art

Methods for making image information visible through an electrostatic latent image, such as an electorophotograohic method, are currently used in various fields. The electrophotographic method comprises forming an electrostatic latent image on a photorecepter in charging and exposure steps, and developing the electrostatic latent image by using a developer containing a toner such that the image becomes visible in transferring and fixing steps.

In a digital image forming device, binary information of two values for "ON" and "OFF" is given as two-dimensional information for a predetermined point on a photorecepter on the basis of character and image data. When such a system is used to record a halftone image, an area modulation method using a dot structure or an innumerable line structure utilizing parallel ten-thousand or more lines has been utilized in many printers and copiers using a digital electrophotographic system because of the relatively simple algorithm and low costs.

In an image forming device, using an electrophotographic system to reproduce multiple gradations, and in such a color image forming device in particular, the developer may be a two-component developer consisting of a toner and a carrier, or a single-component developer such as a magnetic toner which is used alone. The two-component developer is widely used at present because the carrier bears its share of functions, such as agitation, transferring, and charging of the developer. Thus, the two-component developer with its share of functions can provide stable chargeability and high controllability.

As for a developing method, a cascade method was used formerly. At present, the dominant developing method is a magnetic brushing method using a magnetic roll as a carrying member for the developer. Conductive magnetic brushing (CMB) development using a conductive carrier and insulating magnetic brushing (IMB) development using an insulating carrier are known as examples of two-component magnetic brushing development.

IMB development has the features that the relation between the latent image potential and the image density on a photorecepter is linear, and the slope of the linear line indicating the relation is small, but on the other hand, the padding of the solid made from tonner is not supplied well and the edge effect is great. CMB development has the features that there is no edge effect and the padding of the solid made from tonner is supplied well in contrast to the insulating magnetic brushing development. However, the relationship between the latent image potential and the image density on a photorecepter has a steep slope, and there is the drawback that bias leaks cause breaking of the latent image resulting in it being easy for brush marks to be caused.

In particular, image defects due to brush marks significantly impair the quality of color images.

When a black-and-white image is formed by using only a black toner, these problems have no significant effect on the functional image quality if the level of these problems is low. However, these problems prove to be serious when colored toners are overlapped to form a color image. This is because the effect of the above problems in a black-and white image is confined to microscopic changes in density, but in a color image, is expressed as microscopic changes in the color tone, such that noises with different colors are created in a gradation image. The above problems therefore have a significantly adverse effect especially on the functional image quality of a color image.

Several conductive magnetic brushing methods have been disclosed which can solve the above problems and in which the padding of the solid made from tonner is supplied well, the edge effect is reduced and it is difficult to produce brush mark.

For example, Japanese Patent Application Publication (JP-B) No. 7-120,086 discloses a carrier which is produced by coating a core material (hereinafter called "carrier core" or in some cases simply "core") having a relatively low resistance with a highly resistant resin, and is thereby characterized in that the electric resistance thereof rapidly changes in a certain electric field, and in that higher resistances are exhibited in lower electric fields and lower resistances are exhibited in higher electric fields. JP-B No. 7-120,086 explains that since a high electric field is applied to a latent image portion and a low electric field is applied to the portions other than the latent image portion, solid black areas can be printed well, and at the same time, there is no excess application of carrier to the non-latent-image portions. However, judging from the description in the "Examples" and the "Operation" of JP-B No. 7-126,086, it can be assumed that in the invention of JP-B No. 7-126,086, the core having low resistance is partially exposed because the thickness of the coated resin layer is considerably thin. It is thought that such a structure causes the resistance to decrease in high electric fields. In practice, as shown in the comparative examples which will be described later, the electric resistance of a carrier whose a core material was completely coated with a thick resin coating layer was high even in high electric fields, and a good solid image could not be obtained. In the above partially coated carrier in which a part of the low resistance core is exposed, charges easily moves via the exposed surface which makes it easy for brush marks to be formed on the latent image portions.

Ferrites which have relatively low electric resistance and micro-irregularities formed by primary particles on the surface thereof are disclosed in Japanese Patent Application Laid-Open (JP-A) Nos. 61-107257 and 61-130959. These disclosures explain that the provision of such a micro-irregularities suppresses leakage between differently polarized charges and thus prevents the occurrence of brush marks. However, because micro-irregularities are formed on the surface of the carrier, the contact area with the toner increases, giving rise to the problem that the toner is easily adsorbed on the surface of the carrier, and as a result, the charge-donating capability of the carrier deteriorates over time.

In addition, JP-A No. 6-161,157 discloses a material in which the ratio of the electric resistance of a core material of a resin-coated carrier to the electric resistance of the carrier itself is prescribed. It is shown therein that this material satisfies all of resolution, solid image density and reproducibility of fine lines simultaneously. However, a sufficient effect on the prevention of occurrence of image defects especially in color images was not exhibited.

As described above , as for CMB development, judging on the basis of recent stringent requirements for high quality of color images and the like, none of the conventional image forming methods are sufficient with respect to image defects relating to conductive magnetic brushing, specifically, to brush marks due to the breaking of a latent image caused by bias leakage.

SUMMARY OF THE INVENTION

In view of the aforementioned conventional problems, it is an object of the present invention to provide an image forming method and image forming device in which the amount of a toner transferred to a latent image support member is stable even if the sensitivity of a photorecepter is not uniform, the padding of a solid is supplied well, and good half-tone images free from an edge effect and brush marks are obtained while application of excess carrier can be prevented.

The present inventors conducted earnest studies to achieve a developer in which the electric resistance of a carrier coated with a resin layer is controlled whereby a good solid image free from an edge effect can be obtained and the application of excess carrier and brush marks can be prevented. As a result, the present inventors found that, in order to keep the amount of a toner stable, it is necessary to use a developer whose developing curve, which expresses the relation between the amount of the toner transferred onto a latent image support member and the contrast potential which is defined by the developing bias potential applied to a developer support member and the potential of the exposed portion of the latent image support member, has a saturated characteristic. The present inventors also found that by setting the time constant of the developer comprising a carrier and a toner in a fixed range and by controlling the proportion of the toner in the developer to a fixed range, stable developing characteristics and image quality with excellent area gradation can be obtained. Thus, the present inventors achieved the present invention.

The present invention is:

(i) An image forming method comprising an exposure step of effecting exposure on the basis of image data to form an electrostatic latent image on a latent image support member which is uniformly charged, and a developing step of developing the electrostatic latent image by using a developer on a developer support member to make the electrostatic latent image visible, wherein the developer comprises a magnetic carrier and a toner;

a developing curve of the developer at the time when the developer is used has a saturated characteristic, the developing curve being an expression of the relation between the amount of toner transferred to the latent image support member and contrast potential, the contrast potential being determined by the developing bias potential applied to the developer support member and the potential of an exposed portion of the latent image support member;

the proportion of the toner in the developer is in a range from 5 to 10% by weight;

the time constant of the developer is less than or equal to 40 msec; and the developing step comprises applying developing bias voltage to the developer support member such that the amount of the toner transferred to the latent image support member reaches a saturated range.

(ii) An image forming method according to the method (i) wherein the magnetic carrier is produced by coating a core material with a resin coating layer.

(iii) An image forming method according to the method (ii) wherein the film thickness of the resin coating layer is 0.1 to 5 $\mu$m.

(iv) An image forming method according to any one of the methods (i) to (iii) wherein the volumetric average particle diameter of the magnetic carrier is 10 to 100 $\mu$m.

(v) An image forming method according to any one of the methods (ii) to (iv) wherein the core material is a ferrite.

(vi) An image forming method according to any one of the methods (ii) to (v) wherein the resin coating layer contains an electroconductive powder.

(vii) An image forming method according to the method (vi) wherein the electric resistance of the electroconductive powder is less than or equal to $1\times10^6$ Ωcm.

(viii) An image forming method according to the method (vi) or (vii) wherein the electroconductive powder is contained in an amount of 3 to 50% by volume based on the resin coating layer.

(ix) An image forming method according to any one of the methods (i) to (viii) wherein the toner comprises an inorganic micropowder having an electric resistance of $1\times10^6$ Ωcm or less.

(x) An image forming method according to any one of the methods (i) to (ix) wherein the developing bias potential uses a developing bias obtained by superimposing an alternating electric field, whose voltage between peaks 100 to 500 V and whose frequency is 400 Hz to 20 kHz, on a DC electric field.

(xi) An image forming method according to any one of the methods (i) to (x) wherein the latent image contrast potential at the time that the latent image on the latent image supporting member is exposed at an input image area ratio of 50% is 90% or more of the latent image contrast potential formed by the charge potential of the latent image support member and the surface potential at the time that the latest image is exposed at the input image area ratio of 100%.

(xii) An image forming device comprising an exposure means for effecting exposure on the basis of image data to form an electrostatic latent image on a latent image support member which is uniformly charged, and a developing means for developing the electrostatic latent image by using a developer on a developer support member to make the electrostatic latent image visible, the developer comprising a magnetic carrier and a toner, wherein a developing curve of the developer at the time when the developer is used has a saturated characteristic, the developing curve being an expression of the relation between the amount of toner transferred to the latent image support member and contrast potential, the contrast potential being determined by the developing bias potential applied to the developer support member and the potential of an exposed portion of the latent image support member;

the proportion of the toner in the developer is in a range from 5 to 10% by weight;

the time constant of the developer is less than or equal to 40 msec; and the developing step comprises applying a developing bias voltage to the developer support member such that the amount of the toner transferred to the latent image support member reaches a saturated range;

(xiii) An electrostatic latent image developer comprising a magnetic carrier and a toner, wherein the proportion of the toner in the electrostatic latent image developer is in a range from 5 to 10% by weight and the time constant of the developer is less than or equal to 40 msec; and (xiv) An electrostatic latent image developer according to the method (xiii) wherein the toner contains an inorganic micropowder with an electric resistance of $1\times10^6$ Ωcm or less.

The present invention structured as described above can provide an image of high quality which is free from image defects such as brush marks or the application of excess carrier (carrier-over).

These figures are explained in detail in Japanese Patent Application No. 9-190238 (the entire disclosure of which is incorporated by reference).

DESCRIPTION OF THE PREFERRED EMBODIMENTS

The present invention will be described in detail by way of preferred embodiments.

First, the developer used in the present invention will be described.

The developer used in the present invention comprises a magnetic carrier and a toner, and the developing curve thereof, which expresses the relation between the amount of toner transferred to a latent image support member and the contrast potential which is determined by the developing bias potential applied to a developer support member and the potential of the exposed portion of the latent image support member, mast have a saturated characteristic.

Herein, saturated characteristic means that the amount of the toner barely varies at all by variations in the contrast potential, which is determined by the developing bias potential applied to the developer support member and the potential of the exposed portion of the latent image support member.

Figure 1:
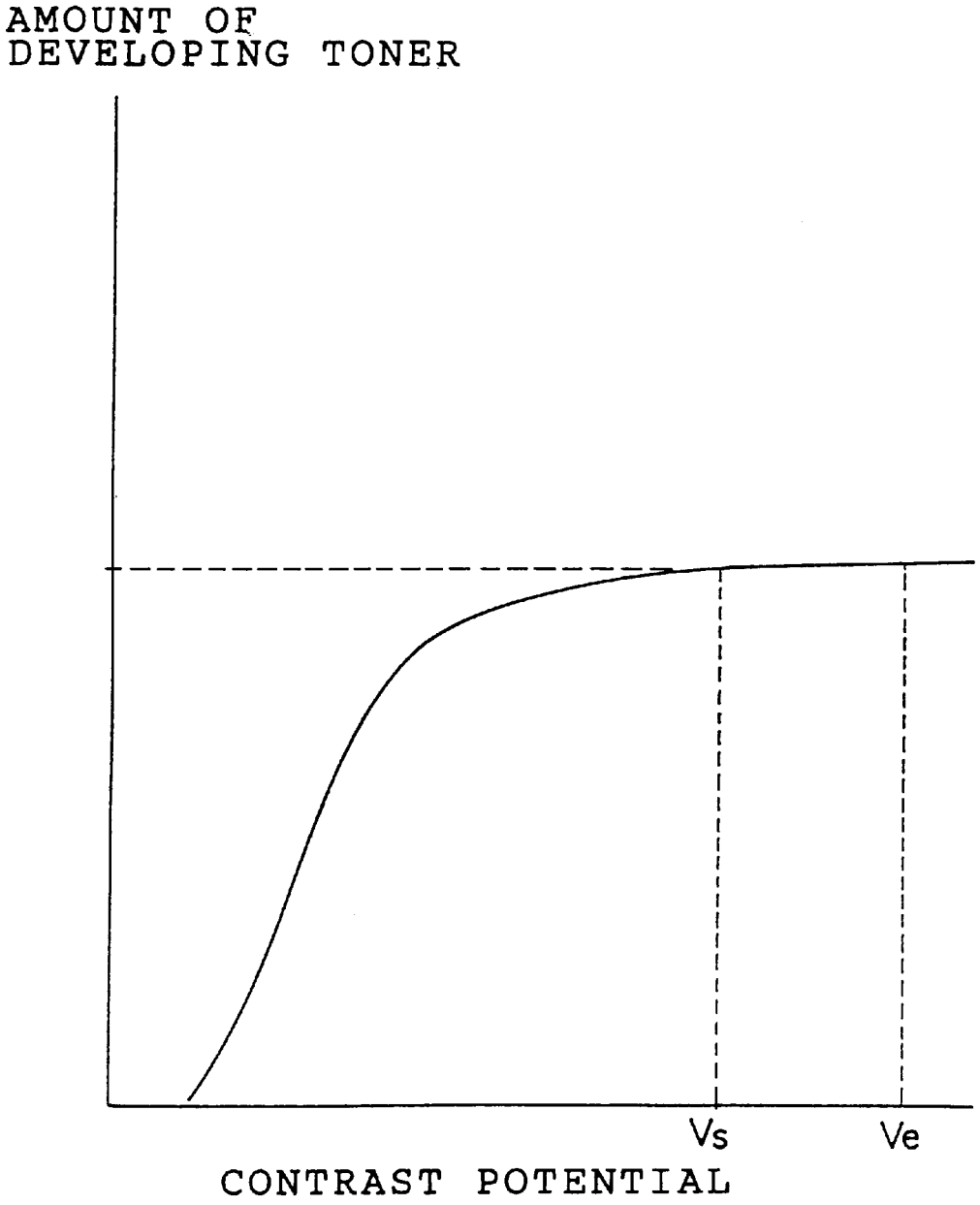
FIG. 1 shows a developing curve for a developer having a saturated characteristic, wherein the curve is based on the contrast potential and the amount of developing toner.

For example, as shown in FIG. 1, when a contrast potential such that the slope of the developing curve is ⅕ or less than at the start of development is $V_s$, a developing bias potential can be applied to the developer support member such that the value calculated by subtracting $|V_1|$, which is the absolute value of the average surface potential $V_1$ of the photorecepter at the exposed portion when the latent image is exposed at the input image area ratio of 100%, from $|V_{bias}|$, which is the absolute value of the developing bias potential $V_{bia}$, is larger than $|V_s|$. As the developing bias potential is set in this manner, the amount of the developing toner is kept stable and a good image can be reproduced even if the sensitivity of the photorecepter is not uniform or the like.

Specifically, it is desirable to use a developing bias potential created by superimposing an alternating electric field, whose voltage between peaks is 100 V to 500 V and whose frequency is 400 Hz to 20 kHz, on a DC electric field.

The developer used in the present invention has a time constant of 40 msec or less and preferably 35 msec or less, whereby the stability of the saturated characteristic can be increased and stable area gradation can be obtained. If the time constant is larger than 40 msec, no stable saturated range can be obtained.

Figure 2:
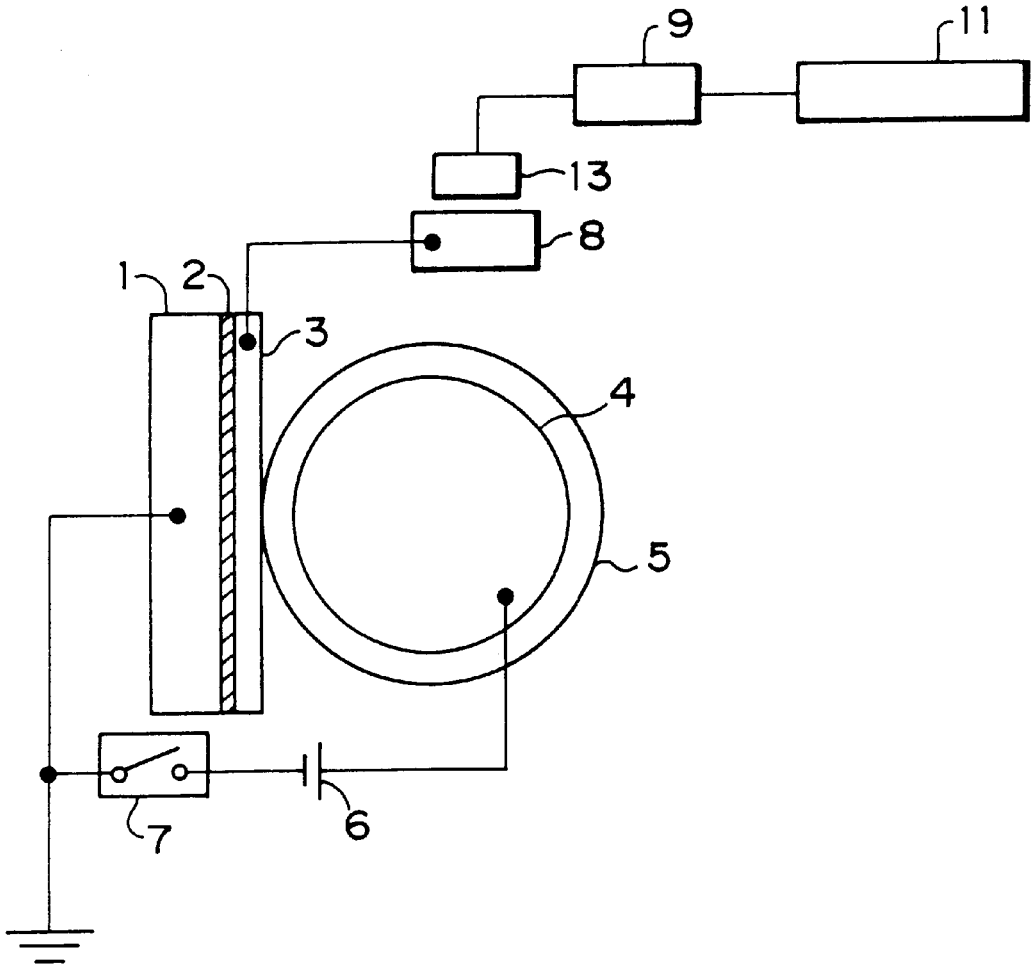
FIG. 2 is a schematic structural view showing an apparatus for measuring the time constant of a developer.

Herein, the time constant of the developer means the value calculated by using the measuring method which will be explained hereinafter with reference to FIG. 2.

Figure 3:
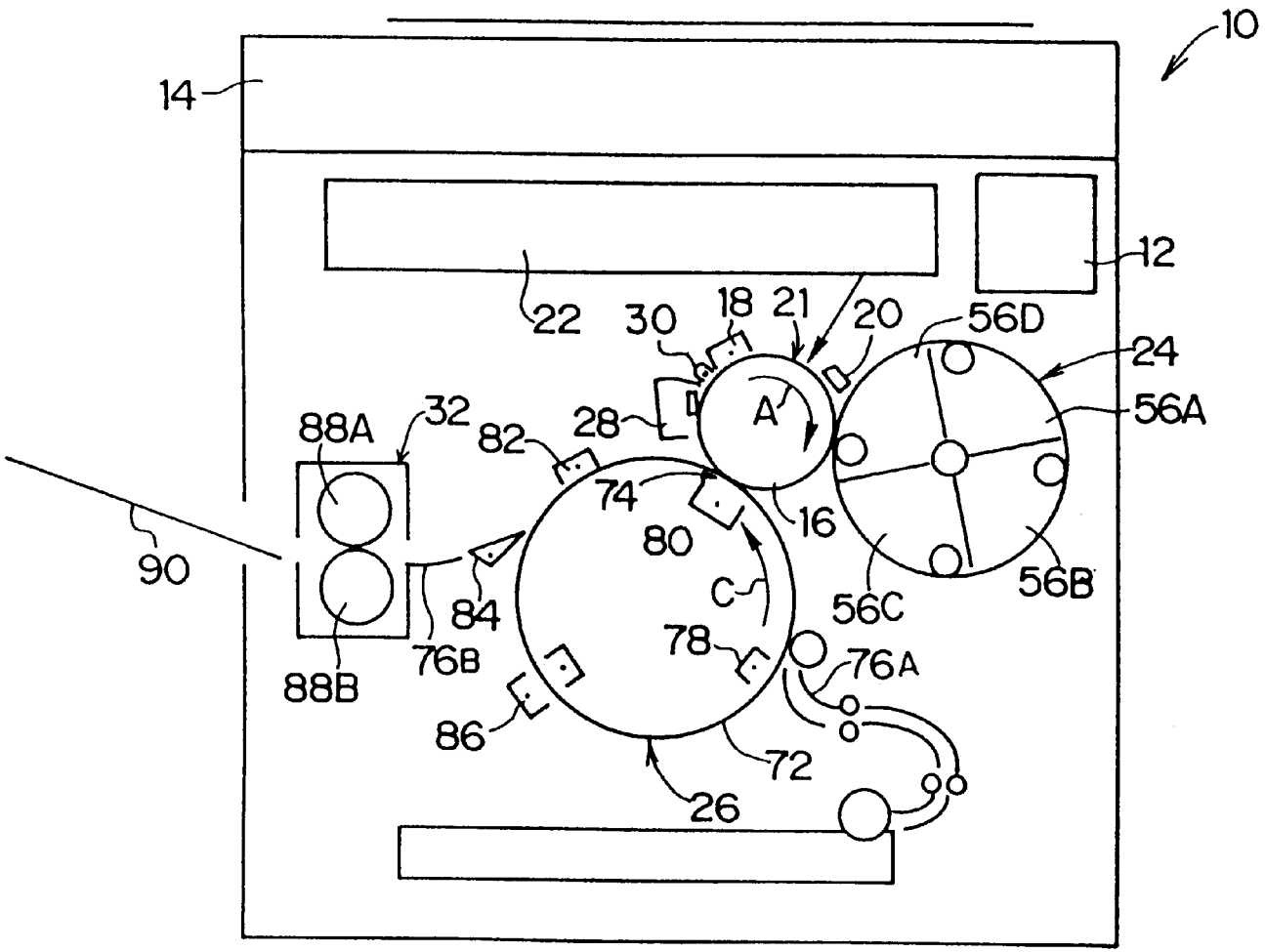
FIG. 3 is an overall structural view of an image forming device to which the image forming method of the present invention is applied.

A polyimide tape 2 having a thickness of 70 μm is bonded as an insulating film to one surface of a 50×50×8 (mm) aluminum plate 1. A 20×60×0.1 mm non-magnetic stainless thin plate (SUS thin plate 3) is applied onto the polyimide tape 2. The resulting product is disposed so as to oppose a developer support member 4 of a developing device (a developing device 24 which will be described later with reference to FIG. 3 in the explanation of the image forming device). The gap between the SUS thin plate 3 and the developer support member 4 is adjusted to 0.5 mm, and a developer is used in an amount of 50 mg/cm$^2$ per unit area to form a magnetic brush 5 on the surface of the developer support member 4. At this time, the contact width between the magnetic brush 5 of the developer and the SUS thin plate 3, i.e., the developing nip width, is about 5 mm. Almost the same developing nip width is obtained as in the image forming device which will be described later, which is illustrated in FIG. 3 and which uses an OPC photosensitive body drum (84 mm ϕ, photosensitive body for A-Color 635). In addition, a 50×70×8 (mm) aluminum plate 8 for measuring potential is electrically connected to the SUS thin plate 3 so as to form a short circuit.

Output from a voltage amplifier 6 (Model 609C manufactured by TReK Co.) is supplied by switching a high-voltage relay 7 from "OFF" to "ON" to apply voltage, which varies stepwise from 0 V to 200 V, across the developer support member 4 and the aluminum plate 1 (at this time, the developer support member 4 is not rotated but is fixed). The SUS thin plate 3 is in contact with the end of the magnetic brush 5 of the developer and hence has the same potential as the end of the magnetic brush 5. Since the circuit between the SUS thin plate 3 and the aluminum plate 8 is shorted, the potential of the tip of the magnetic brush 5 can be measured by measuring the potential of the aluminum plate 8.

The potential of the aluminum plate 8 was measured using a non-contact type surface electrometer 9 (Model 362A manufactured by TReK Co.). The measured data was recorded using a recorder 11 (OMNILIGHT 8M36, manufactured by NEC San-ei). Incidentally, a probe 13 (Model 3627, manufactured by TReK Co.,) for the surface electrometer 9 was used.

The time constant of the developer is defined as the period of time from the instant that voltage is applied stepwise as mentioned above to the time when the potential of the tip of the magnetic brush 5 rises up to 100 V, which is one-half of the applied voltage.

The time constant, i.e., the time-delay of the measurement system, at the time when voltage is applied stepwise directly to the SUS thin plate 3 is several tenths of a millisecond, which is a negligible level in light of the object of determining the upper limit at which the saturated characteristic of the developer appears.

In order to adjust the time constant to fall in the above range, the combination of the electric resistance of the magnetic carrier and the toner is important. Additives to the toner and the concentration of the toner in the developer are of special importance. The magnetic carrier, toner, and the additives to the toner which are preferably used to adjust the time constant will be separately described hereinafter:

[Magnetic carrier]

First, the magnetic carrier (hereinafter simply called "carrier") will be described.

As the core material for the carrier, known iron powder, ferrite, magnetite, magnetic powder dispersion-type resin carrier, or the like may be appropriately used. Among these, a ferrite is particularly desirable because the resistance thereof can be lowered by reducing the ferrite at a certain temperature, for example, in a hydrogen stream after baking, and because core materials having various electric resistances can be prepared by controlling the amount of the hydrogen flow, the temperature, the reduction time, and the like.

The electric resistance of the core material used in a magnetic brush form is preferably 1 Ωcm or less in an electric field of $10^4$ V/cm which is near the developing electric field in actual machines. When the electric resistance of the core material exceeds 1 Ωcm, the electric resistance of the carrier for obtaining the saturated range must be reduced, which makes it easy for brush marks to occur due to bias leakage and for excess carrier to be applieed. An electric resistance exceeding 1 Ωcm is therefore undesirable. A specific method of measuring the electric resistance of the core material used in a magnetic brush form will be described later.

The electric resistance of the core material can be controlled, for example, by varying the amount of existent trace elements and the level of oxidation treatment of the surface in the case of using iron powder, and by varying the mixing ratio of the metal oxides and heat treating conditions after granulation in the case of using a ferrite. Core materials to which various electric resistances are imparted by varying the types of raw materials and process conditions in this manner are commercially available from manufacturers of magnetic materials. Such commercially available core materials may be used in the present invention.

Examples of resins for forming the resin coating layer include polyolefin type resins such as polyethylene, polypropylene and the like; polyvinyl type resins or polyvinylidene type resins such as polystyrene, acryl resins, polyacrylonitrile, polyvinyl acetate, polyvinyl alcohol, polyvinyl butyral, polyvinyl chloride, polyvinyl carbazole, polyvinyl ether, polyvinyl ketone and the like; vinyl chloride-vinyl acetate copolymers; styrene-acrylic acid copolymer; straight silicon resins containing an organosiloxane bond or modifications thereof; fluorine type resins such as polytetrafluoroethylene, polyvinyl fluoride, polyvinylidene fluoride, polychlorotrifluoroethylene and the like; polyester; polyurethane; polycarbonate; amino resins such as urea-formaldehyde resins; epoxy resins, and the like. These resins may be used either singly or plural resin may be used togather.

The thickness of the resin coating layer is from 0.1 to 5 μm and preferably from 0.5 to 3 μm. When the thickness is less than 0.1 μm, it is difficult to coat the projections of an uneven surface of the carrier core, leading to easy occurrence of brush marks. When the thickness exceeds 5 μm, the magnetization characteristic of the carrier tends to be lowered and the formation of heads of the carrier on the developer support member (magnetic roll) tends to be unstable.

The electric resistance of the resin coating layer is preferably from 10 to $1\times10^8$ Ωcm and more preferably from $10^3$ to $10^7$ Ωcm. When the electric resistance of the resin coating layer exceeds $1\times10^8$ Ωcm, the electric resistance of the entire magnetic carrier increases and a good solid image cannot be obtained even if the electric resistance of the core material is low. On the other hand, when the electric resistance of the resin coating layer is less than 10 Ωcm, electro-conduction through the resin coating layer is predominant which causes brush marks and carrier-over to occur easily. Incidentally, an insulating resin coating layer may be used in the case where the thickness of the resin coating layer is less than 0.3 μm.

In order to have the electric resistance of the resin coating layer fall in the above range, an electroconductive powder may be added to the resin coating layer. As the electroconductive powder to be added to the resin coating layer, compounds having an electric resistance of $1\times10^6$ Ωcm or less are preferably used. Specific examples of the electroconductive powder include carbon black, zinc oxide, titanium oxide, stannic oxide, iron oxide, titanium black, and the like. The content of the electroconductive powder may be generally from 0.1 to 50% by volume of the resin coating layer, preferably from 3 to 50% by volume of the resin coating layer, and more preferably from 3 to 30% by volume of the resin coating layer.

Examples of a method for forming the resin coating layer on the core material include a dipping method in which the core material is dipped in a resin coating layer forming liquid which is prepared by dissolving a resin and dispersing electroconductive powder in a solvent; a spraying method in which a resin coating layer forming liquid is sprayed on the surface of the core material; a fluidized bed method in which a resin coating layer forming liquid is sprayed while the core material is floated by air-flow; a kneader-coater method in which the core material and a resin coating layer forming liquid are mixed in a kneader-coater, followed by distilling a solvent; and a method in which a magnetic powder, an electroconductive powder, apolymerizable monomer, and apolymerization initiator or catalyst are added to a solvent to form a coating layer by a polymerization reaction.

No particular limitations are imposed on the solvent used for producing the resin coating layer forming solution insofar as it can dissolve the resin. Examples of the solvent include aromatic solvents such as toluene, xylene and the like, ketones such as acetone, methyl ethyl ketone and the like, and ethers such as tetrahydrofuran, dioxane and the like. For the dispersion of the electroconductive powder, a sandmil, homomixer, or the like may be used.

The magnetic carrier formed in the above manner preferably has an electric resistance of $10^0$ to $1\times10^9$ Ωcm in an electric field of $10^4$ V/cm when it is used in a magnetic brush form. If the electric resistance of the magnetic carrier is less than $1\times10^0$ Ωcm, the carrier is adsorbed on to the latent image support member and brush marks tend to occur. On the other hand, if the electric resistance of the magnetic carrier exceeds $1\times10^9$ Ωcm, no saturated range of the developer can be obtained. It is more preferable that the electric resistance of the magnetic carrier is in a range from $10^3$ to $10^9$ Ωcm.

In a specific method for measuring the electric resistance of the core material and the magnetic carrier used in a magnetic brush form, the core material or the carrier is filled to a space between the developer support member and a plate electrode disposed in the vicinity of the developer support member to form a magnetic brush, and the electric resistance is calculated from the current flowing when the above voltage is applied and the relational formula, log J √E, wherein E and J represent the applied electric field and the current density respectively. In a case where the electric resistance cannot be measured in a high electric field of $10^3$ V/cm or more since the electric resistance of the magnetic carrier or the core material (particularly the core material) is too low, the electric resistance in the electric field used in actual measurement is converted (extrapolated) into electric resistance in an electric field of $10^4$ V/cm based on the above relational formula, so as to determine the object electric resistance.

The volumetric average particle diameter of the above magnetic carrier is preferably from 10 to 100 μm and more preferably from 20 to 80 μm. When the volumetric average particle diameter of the magnetic carrier is less than 10 μm, the developer scatters from the developing apparatus, whereas when the volumetric average particle diameter of the magnetic carrier exceeds 100 μm, a sufficient image density cannot be obtained.

[Toner and Additives to the Toner]

The toner comprises a binding resin and colorants, and additives as required.

Examples of the binding resin for the toner include homopolymers or copolymers including styrenes such as styrene, chlorostyrene and the like; mono-olefins such as ethylene, propylene, butylene, isoprene and the like; vinyl esters such as vinyl acetate, vinyl propionate, vinyl benzoate, vinyl acetate and the like; α-methylene aliphatic mono-carboxylate esters such as methylacrylate, ethylacrylate, butylacrylate, dodecylacrylate, octylacrylate, phenylacrylate, methylmethacrylate, ethylmethacrylate, butylmethacrylate, dodecylmethacrylate and the like; vinyl ethers such as vinyl methyl ether, vinyl ethyl ether, vinyl butyl ether and the like; and vinyl ketones such as vinyl methyl ketone, vinyl hexyl ketone, vinyl isopropenyl ketone and the like; polyester, polyurethane, epoxy resins, silicon resins, polyamide, modified rosin, paraffin, and waxes. Among these, typical binding resins are, for example, polystyrene, styrene-acrylate copolymers, styrene-methacrylate copolymers, styrene- acrylonitrile copolymers, styrene-butadiene copolymers, styrene-maleic acid anhydride copolymers, polyethylene, polypropylene and the like.

Typical examples of the colorants include carbon black, nigrosine, Aniline Blue, Chalcoil Blue, chrome yellow, ultramarine blue, Du Pont Oil Red, Quinoline yellow, Methylene Blue chloride, Phthalocyanine Blue, Malachite Green Oxalate, lamp black, Rose Bengal, C.I. Pigment Red 48:1, C.I. Pigment Red 122, C.I. Pigment Red 57:1, C.I. Pigment Red 238, C.I. Pigment Yellow 97, C.I. Pigment Yellow 12, C.I. Pigment Yellow 17, C.I. Pigment Yellow 180, C.I. Pigment Yellow 185, C.I. Pigment Blue 15:1, C.I. Pigment Blue 15:3 and the like.

The toner may contain additives, e.g., known charge control agents, fixing assistants, and the like.

As the additives which are added to the toner, inorganic micropowder with an electric resistance of $10^6$ Ωcm or less is preferable and inorganic micropowder with an electric resistance of $10^4$ Ωcm or less is more preferable to control the time constant of the developer. If the electric resistance exceeds $10^6$ Ωcm, it is difficult to reduce the time constant of the toner, and a large amount of the inorganic micropowder must be used whereby the transparency of the color fixed image tends to be impaired. Examples of materials used for the inorganic micropowder are metal oxides such as titanium oxide, stannic oxide, zirconium oxide, tungsten oxide, and iron oxide, and nitrides such as titanium nitride. In the present invention, the inorganic powder is preferably colorless or has a weak coloring effect.

As the method for adding the above inorganic powder to the toner, for example, a conventionally known method may be adopted in which the inorganic micropowder and coloring particles (a raw toner to which no additives are added) are placed in a Henshel mixer and mixed. The particle diameter of the inorganic micropowder is preferably 0.5 μm or less. A particle diameter larger than 0.5 μm causes poor transparency of a copy image and hence is not used. The amount of the inorganic micropowder is preferably from 0.05 to 5 parts by weight and more preferably from 0.1 to 3 parts by weight based on 100 parts by weight of the coloring particles.

As other additives which can be added for purposes other than for controlling the time constant, a fluidity control agent, cleaning assistant, and the like are exemplified. For example, silicon oxide, aluminum oxide, and the like may be used either singly or in combinations of two or more. These additives are added in an amount preferably 0.05 to 5 parts by weight and more preferably 0.1 to 3 parts by weight based on 100 parts by weight of the coloring particles.

As for the production method for the toner used in the present invention, any conventionally known method may be used. Examples of the production method are a kneading-milling method in which a resin, a binding resin, is heat-melted, kneaded with a colorant and then cooled, followed by pulverizing and classifying; and wet production methods, e.g., a suspension polymerization method, emulsion dispersion method, and dissolution suspension method.

The proportion of the toner in the developer is in a range from 5 to 10% by weight. When the proportion is less than 5% by weight, brush marks tend to occur, whereas when the proportion exceeds 10% by weight, a saturated characteristic cannot be obtained.

In an image forming method comprising an exposure step of effecting exposure on the basis of image data to form an electrostatic latent image on a latent image support member which is uniformly charged and a developing step of developing the electrostatic latent image by using a developer on a developer support member, or in an image forming device comprising an exposure means for effecting exposure on the basis of image data to form an electrostatic latent image on a latent image support member which is uniformly charged and a developing means for developing the electrostatic latent image by using a developer on a developer support member, the present invention is structured such that the above-described developer is used as the developer, and the present invention further comprises a step or means for applying developing bias voltage to the developer support member such that the amount of the toner transferred to the latent image support member exhibits a saturation characteristic.

The image forming device to which the image forming method of the present invention is applied will be explained.

FIG. 3 is a schematic structural view showing an example of the image forming device according to the present invention.

An image forming device 10 comprises a control section 12 for controlling the entire image forming device 10; an original reading section 14 in which the original is irradiated by light to create image signals for each color from the light transmitted through or reflected by the original; a photorecepter 16 serving as a latent image support member and rotating in the direction of arrow A; a charger 18 which is disposed in the vicinity of the photorecepter 16 and uniformly charges the photorecepter 16; a potential sensor 20 which is disposed at the rotating direction downstream side the charger 18 and detects the potential of the charged photorecepter 16; a light beam scanning device (ROS) 22 which, on the basis of image data from the original reading section 14, scan-exposes the charged photorecepter 16 in an exposure section 21 formed at the rotating direction upstream side of the potential sensor 20, so as to form a latent image; a rotary developing unit 24 which is disposed at the rotating direction downstream side of the exposure section 21 and transfers toners to the latent image to form a visible image; a transfer unit 26 which is disposed at the rotating direction downstream side of the rotary developing unit 24 and transfers the visible image to a recording material; a cleaner 28 which is disposed at the rotating direction downstream side of the transfer unit 26 and removes the toner remaining on the photorecepter 16; a pre-exposure unit 30 which exposes the photorecepter 16 to eliminate residual potential; and a fixing unit 32 which fixes the visible image on the recording material.

The original reading section 14 comprises a light source (not shown) which emits light onto the original; a color filter (not shown) which separates into respective colors which is transmitted through or reflected by the original; a photoelectric converter (not shown) which converts the intensities of the lights of the respective colors into electric signals which are analog data; an A/D (analog-digital) converter (not shown) which converts the electric signals of the respective colors into image signals of the respective colors which are digital data; and a memory (not shown) which stores the image signals of the respective colors. The image signals stored in the memory are successively output for the respective colors to the light beam scanning device 22 on the basis of signals from the control section 12.

Figure 4:
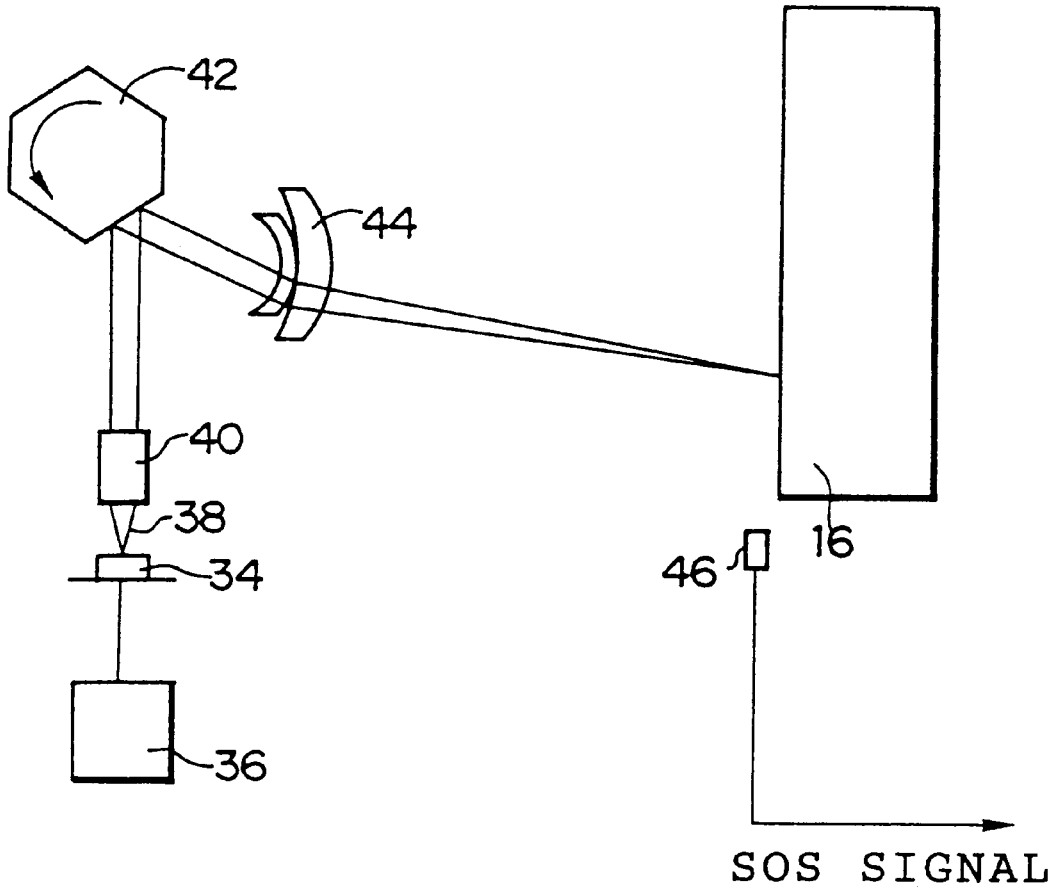
FIG. 4 is a structural view of a light-beam scanning device used in the image forming apparatus shown in FIG. 3.

As shown in FIG. 4, the light beam scanning device 22 comprises a semiconductor laser 34 which emits a laser beam 38; a pulse width modulation device 36 which switches the semiconductor laser 34 on and off according to the image signals from the original reading section 14; a collimator lens 40 which converts a laser beam 38 emitted from the semiconductor laser 34 into parallel beams; a polygon mirror 42 which deflects the parallel beams from the collimator lens 40 at a constant angular velocity toward the photorecepter 16; an fθ lens 44 which is disposed between the polygon mirror 42 and the photorecepter 16 and forms a beam spot of a predetermined size on the photorecepter 16; and a start-of-scan signal generating sensor 46 which generates an SOS signal for detecting the timing of the start of scanning.

Figure 5:
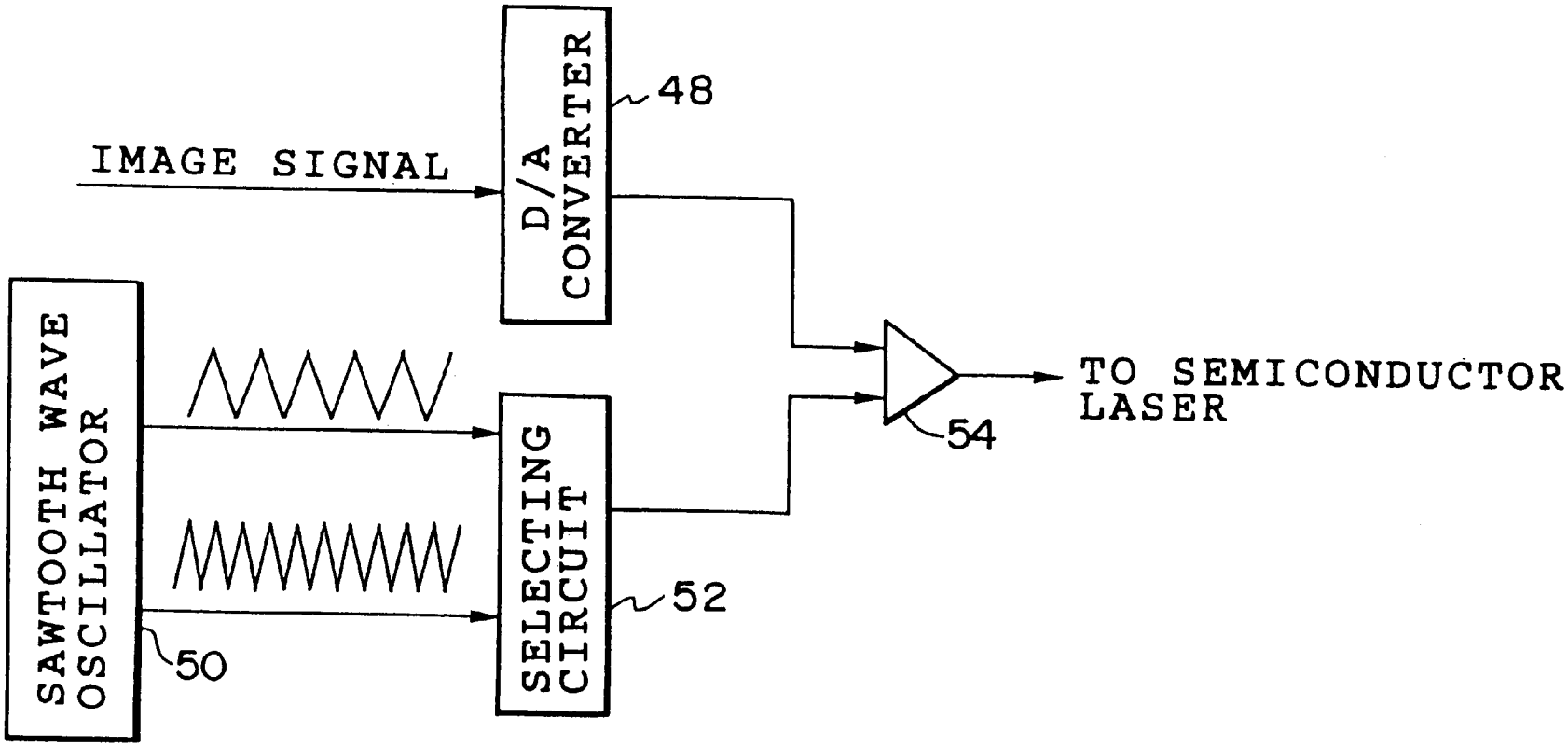
FIG. 5 is a structural view of a pulse width modulator used in the light-beam scanning device shown in FIG. 4.

As shown in FIG. 5, the pulse width modulation device 36 comprises a D/A converter 48 which converts the image signals, which are digital data, from the original reading section 14 into electric signals which are analog data; a sawtooth wave oscillator 50 which forms a plurality of sawtooth waves with different frequencies; a waveform selecting circuit 52 which, in accordance with the resolution, selects a sawtooth wave with a desired frequency from the plurality of sawtooth waves formed at the sawtooth wave oscillator 50; and a comparison circuit 54 which outputs an on-signal to switch on the semiconductor laser 34 when the voltage of the sawtooth wave output from the waveform selecting circuit 52 is greater than or equal to the voltage of the electric signals output from the D/A converter 48. In accordance with the above structure, an on-signal of a length corresponding to the image density of the original is output.

As shown in FIG. 3, the rotary developing unit 24 is cylindrical and is provided with four reverse-developing-type and two-component-developing-type developing sections 56 (56A to 56D) for yellow, cyan, magenta, and black.

Figure 6:
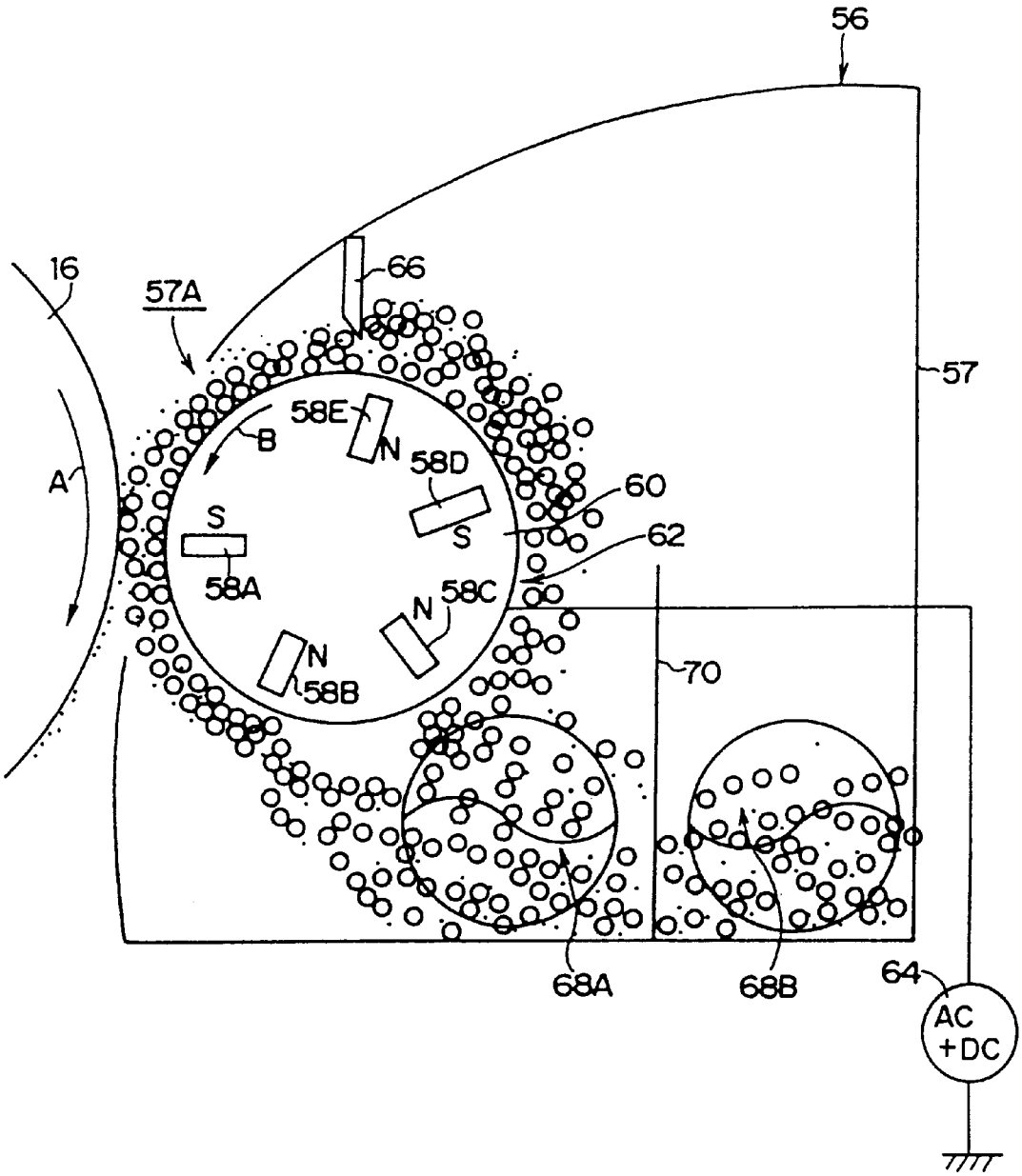
FIG. 6 is a schematic structural view of a developing section forming a rotary developing unit used in the image forming device shown in FIG. 3.

FIG. 6 shows a schematic structure of the developing section 56 comprising a developing housing 57 which is shaped as a fan-shaped section of a cylinder and is provided with an opening portion 57A formed in the outer periphery along the axial direction; a magnetic roll 62 which comprises a plurality of fixed magnets 58 (58A to 58E) disposed radially and a developing sleeve 60 which rotates in the direction of arrow B around the fixed magnets 58; a bias power source 64 which supplies, to the developing sleeve 60, DC-superimposed AC bias voltage for allowing the toner to be adsorbed on the exposed portion of the photorecepter 16; a trimmer bar 66 which is disposed at the rotational direction upstream side of the opening portion 57A and keeps the thickness of the magnetic brush comprising the developer constant; screw augers 68A, 68B which are disposed below the magnetic roll 62 and agitate the developer; a dividing wall 70 which is disposed between the screw augers 68A, 68B and provided with an opening portion (not shown), formed at its end; and a toner supplier (not shown) which supplies replenishing toner to the screw auger 68B. The magnetic roll 62, the screw augers 68A, 68B, the trimmer bar 66, the toner supplier, and the dividing wall 70 are housed in the developing housing 57.

The magnetic roll 62 is installed such that its axial direction coincides with the axial direction of the photorecepter 16. Further, the rotary developing unit 24 is disposed such that a predetermined gap is formed between the magnetic roll 62 contained in the developing section 56 and the photorecepter 16 when the opening portion 57A of the developing housing 57 in each developing section 56 is positioned so as to oppose the photorecepter 16.

Furthermore, the plurality of fixed magnets 58 is arranged such that the fixed magnets 58B, 58C, which are disposed at the rotational direction downstream side of the opening portion 57A and are adjacent to each other, have the same polarities, and other neighboring fixed magnets, specifically, 58C and 58D, 58D and 58E, 58E and 58A, and 58A and 58B respectively have polarities opposite to one another. The magnetic brush which is adsorbed to the magnetic roll 62 by the attracting power of the fixed magnets 58C, 58D located above the screw auger 68A is conveyed to the opening portion 57A of the developing housing 57 by the attracting power of the fixed magnets 58D and 58E and of the fixed magnets 58E and 58A and by the rotation of the magnetic roll 62 and brushes against (develops) the photorecepter 16. Then, toner remaining on the magnetic roll 62 is removed from the magnetic roll 62 by the repulsive force of the fixed magnets 58B, 58C and drop downward to the lower portion of the developing housing 57.

The directions of rotation of the screw augers 68A, 68B are opposite to each other, and an opening portion (not shown) which is formed at the end portion of the dividing wall 70 allows the developer to be introduced. The replenished developer in which the toner and the carrier are sufficiently agitated is thus supplied to the magnetic roll 62.

The rotary developing unit 24 having the above structure is connected to a driving unit (not shown) connected to the control section 12 and rotates intermittently based on the signals from the control section 12. Every time a latent image of a color is formed, the latent image is developed with a toner having the corresponding color.

As shown in FIG. 3, the transfer unit 26 is provided with a transfer drum 72 which rotates in the direction of the arrow C. The transfer drum 72 is disposed such that the axial direction thereof is parallel to the axial direction of the photorecepter 16 and a predetermined gap is formed between the photorecepter 16 and the transfer drum 72. At the periphery of the transfer drum 72 are provided: a recording material-attracting charger 78 which is disposed at the rotational direction upstream side of a transfer portion 74 at which the transfer drum 72 and the photorecepter 16 are close to each other, and which charges the transfer drum 72 to attract a recording material conveyed from a carrier path 76; a transfer charger 80 which is disposed adjacent to the transfer portion 74 and transfers a toner image formed on the photorecepter 16 to the transfer drum 72; a peeling charger 82 which is disposed at the rotational direction downstream side of the transfer charger 80 and charges the transfer drum 72 to peel off the recording material which is attracted to the transfer drum 72; a peeling claw 84 which is disposed at the rotating direction downstream side of the peeling charger 82 and peels off the recording material from the transfer drum 72; and a charge-removing charger 86 which is disposed at the rotating direction downstream side of the peeling claw 84 and removes the charges remaining on the transfer drum 72.

The fixing unit 32 is disposed on the carrier path 76 at the conveying direction downstream side of the peeling claw 84, and is provided with a pair of fixing rollers 88A, 88B sandwiching the carrier path 76 between them. At least one of the pair of fixing rollers 88A, 88B is heated by a heater (not shown). The recording material conveyed from the transfer unit 26 is introduced into the nip portion of the pair of fixing rollers 88A, 88B and is heated thereat so as to fix a multicolor image onto the recording material.

A tray 90 is disposed at the conveying direction downstream side of the pair of fixing rollers 88A, 88B. The recording material onto which an image has been fixed is guided into the tray 90 due to the rotations of the pair of fixing rollers 88A, 88B.

In the above-described image forming device 10, an original is read by the original reading section 14 thereby forming image signals of respective colors which are successively output to the light beam scanning device 22. The photorecepter 16 is charged and a latent image of each of the colors is formed on the photorecepter 16 by the light beam scanning device 22. Each time a latent image of a color is formed, the rotary developing unit 24 develops the latent image with a toner having the corresponding color. The developed toner image with a specific one color is transferred onto a recording material attracted to the transfer drum 72. The aforementioned formation of a latent image, development, and transfer are repeated for each color to form a multicolor image on the recording material. The recording material on which the multicolor image has been formed is conveyed to the fixing unit 32 for fixing, and then finally to the tray 90.

The latent image formed in the above image forming device 10 is represented in a binary digit form. The latent image binarized will be explained.

Figure 7A:
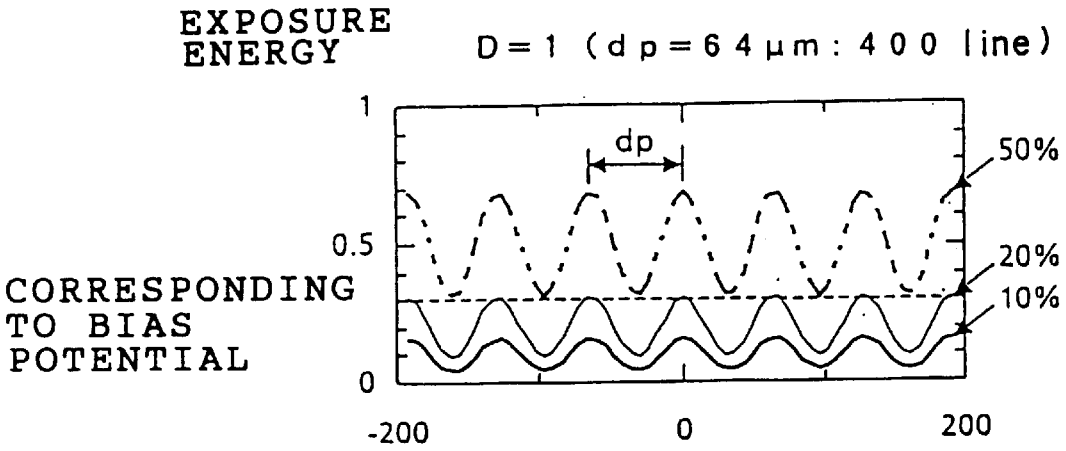
FIG. 7 is the exposure energy profile of a photorecepter.
Figure 7B:
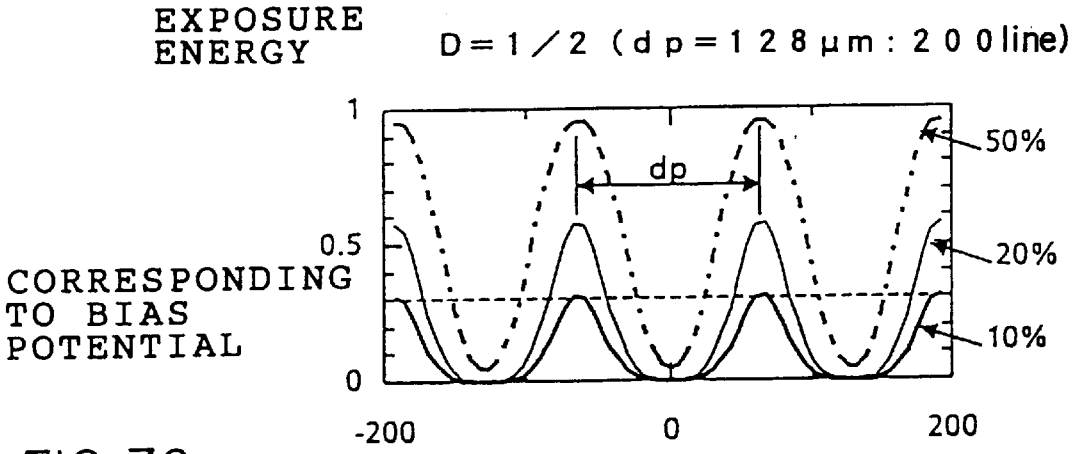
Figure 7C:
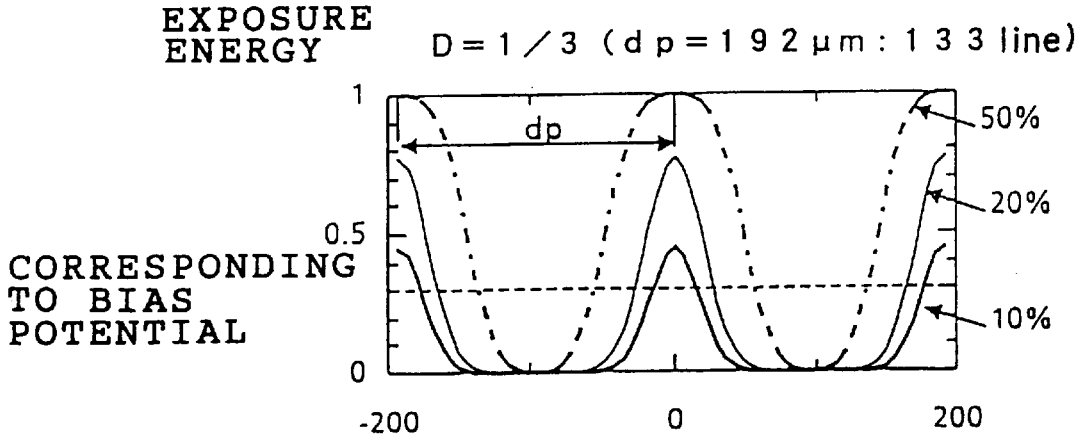
Figure 8:
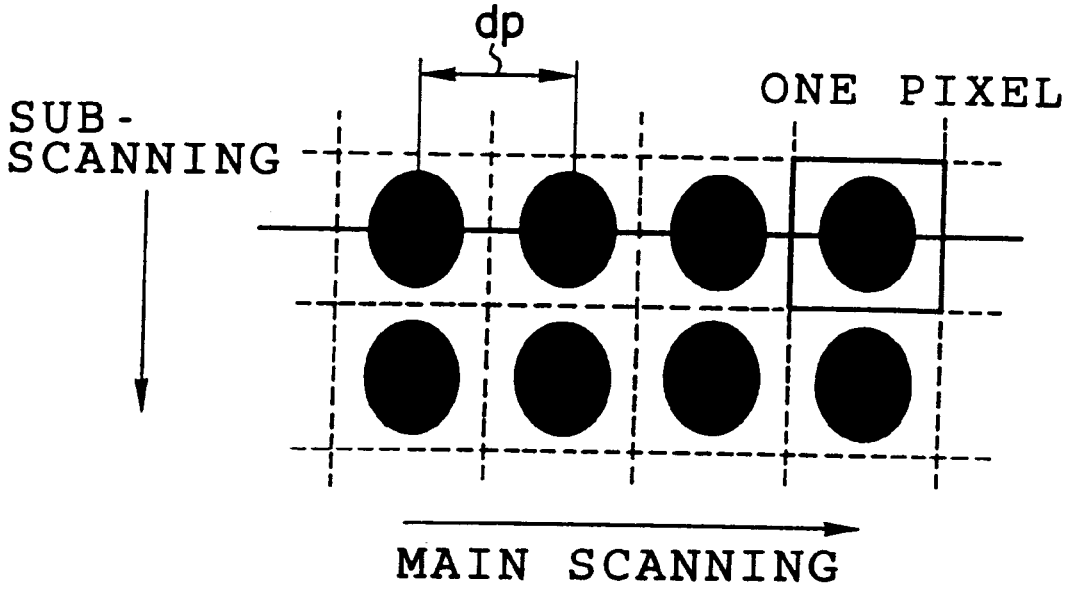
FIG. 8 is a diagram for explaining the distance between pixels.

FIG. 7 shows profiles of exposure energy on the photorecepter when the photorecepter is exposed by using a light beam scanning device at input image area ratios of 10%, 20%, and 50%, provided that the light beam spot diameter dB (mm) is constant, and the ratio (dB/dP) of the beam spot diameter dB to the distance dP (mm) (see FIG. 8) between neighboring pixels is set to be 1/1, 1/2, and 1/3. As can been seen from FIG. 7, the contrast of the profile of exposure energy decreases more and becomes more analog-like as the value of D is increased from 1/3, 1/2 to 1/1.

Figure 9A:
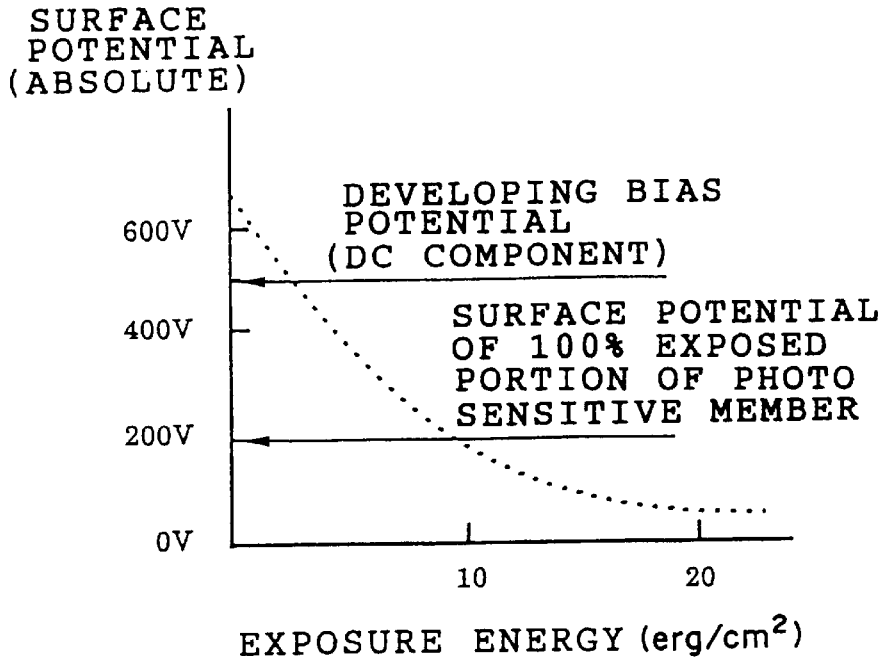
FIG. 9 shows the photo-voltage attenuation characteristic of a photorecepter.
Figure 9B:
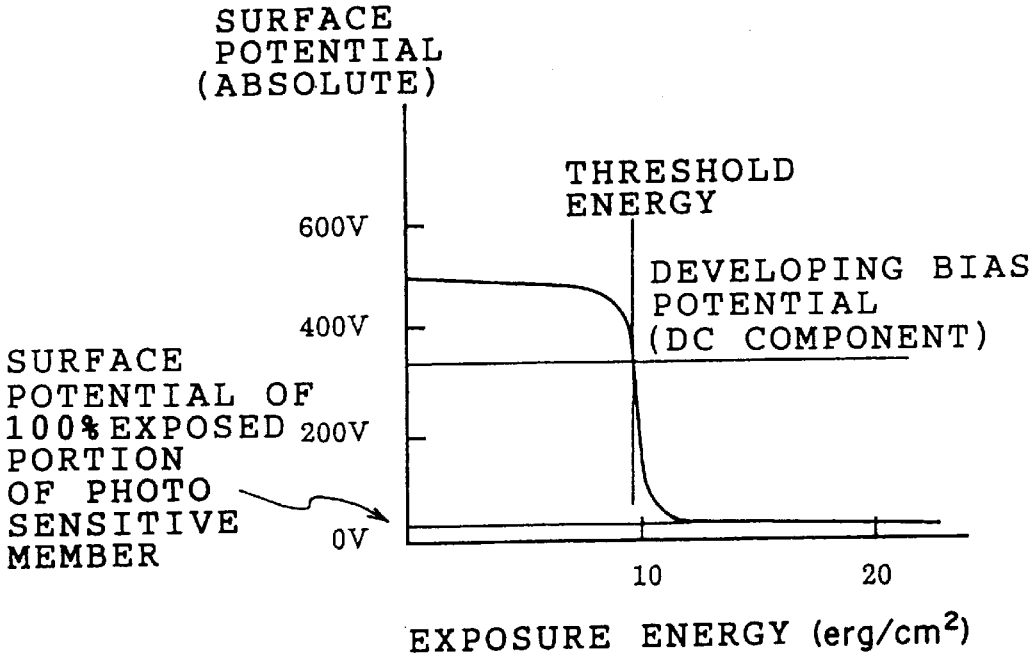
Figure 10A:
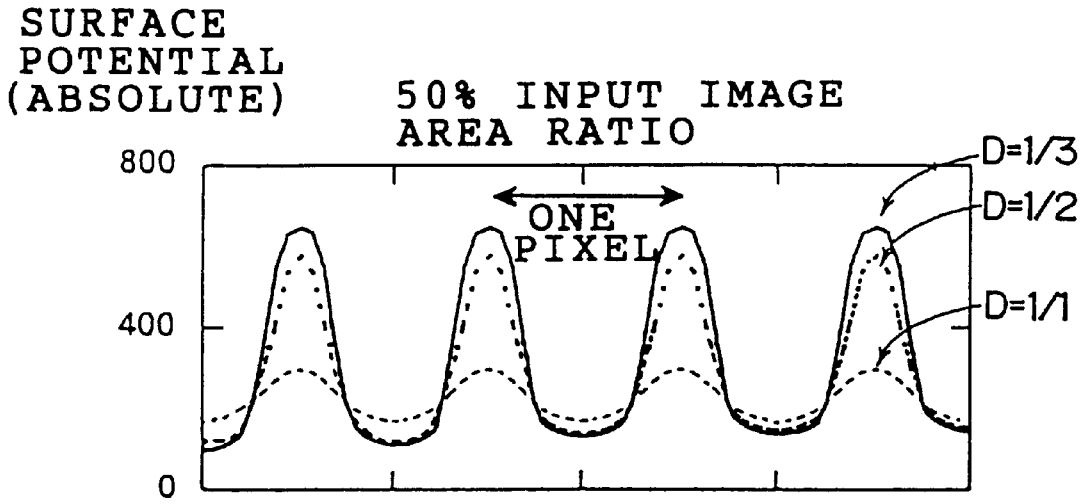
FIG. 10 shows a binary potential profile of a photorecepter.
Figure 10B:
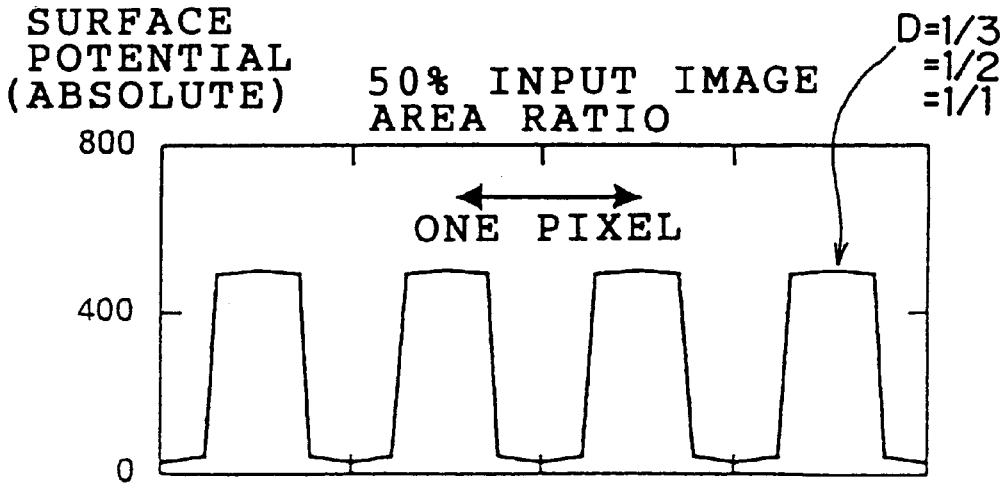

FIGS. 9(*a*) and 9(*b*) show photo-potential attenuation characteristics of the photorecepter. FIG. 10(*a*) shows the results of the surface potential profile of the photorecepter calculated when the photorecepter having the photo-potential attenuation characteristic shown in FIG. 9(*a*) is exposed at an input image area ratio of 50% by using the exposure energy profile shown in FIG. 7 while the value of D is varied. The calculation method is described, for example, in "Proceedings IS&T's 9th International Congress on Advances in Non-Impact Printing Technologies, Vol. 9", pages 97–100. (The disclosure of this publication is incorporated herein by reference.)

As can been seen from FIG. 10(*a*), as the value of D is increased, the contrast of the exposure energy profile decreases. This is accompanied by a lowering of the contrast of the surface potential profile of the latent image.

In the present specification, the latent image is binarized. This means that the latent image contrast potential $|Va-Vb|$, which is calculated from the surface potential Va of the exposed portion (the portion to be essentially exposed) of the photorecepter and the surface potential Vb of the non-exposed portion (the portion to not be essentially exposed) of the photorecepter at the time that the latent image on the latent image support member is exposed at an input image ratio of 50%, is 90% or more of the latent image contrast potential $|Vh-V1|$ which is calculated from the charge potential Vh of the photorecepter and the average surface potential V1 of the exposed portion of the photorecepter at the time that the latent image is exposed at the input image area ratio of 100%.

Accordingly, when a photorecepter having the photo-potential attenuation characteristic shown in FIG. 9(*a*) is used, a latent image can be binarized by setting the value of D to be ½ or less.

Further, when a photorecepter having the photo-potential attenuation characteristic shown in FIG. 9(*b*) is used, a latent image can be binarized by appropriately controlling the exposure energy even if the value of D is 1.

EXAMPLES

The present invention will be illustrated in further detail by way of Examples and Comparative Examples.

Developers used in the Examples and Comparative Examples were produced as follows:

I. Production of Carrier

Carrier 1 (Used in Examples 1 and 2 and Comparative Examples 1 and 2)

| | |
|---|---|
| Magnetite (trade name: MX030A, manufactured by Fuji Electrochemical Co., Ltd., average particle diameter: 50 $\mu$m) | 100 parts by weight |
| Toluene | 13.5 parts by weight |
| Styrene/methylmethacrylate copolymer (copolymerization ratio: 20:80, weight average molecular weight: 73,000) | 1.8 parts by weight |
| Carbon black (Trade name: VXC72, manufactured by Cabot, electric resistance: $10^{-1}$ Ω cm, specific gravity: 1.8) (8.5% by volume of the resin coating layer) | 0.3 parts by weight |

The above components except for the magnetite were dispersed by using a sandmill for one hour to prepare a resin coating layer forming solution. The resin coating layer forming solution and the magnetite were placed in a vacuum degassing type kneader and stirred under reduced pressure at 60° C. for 20 minutes to form a resin coating layer on the magnetite, thereby obtaining a carrier 1. The thickness of the resin coating layer was 0.8 μm.

Figure 11:
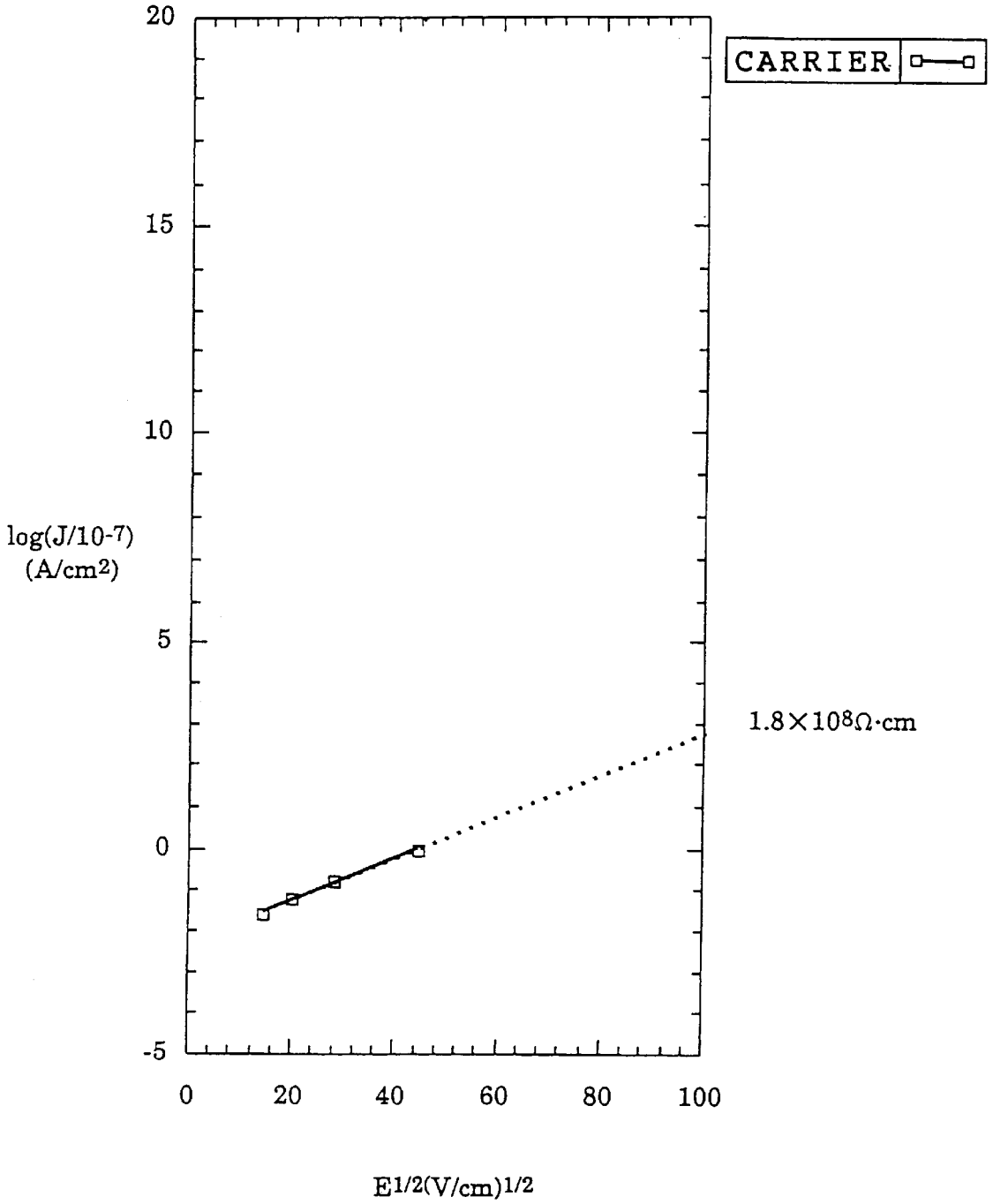
FIG. 11 shows the relation between current density J and applied field E which results from the measurement of electric resistance (a value extrapolated at an electric field of $10^4$ V/cm) using the carrier and the core thereof used in the present invention which are in magnetic brush form.

The electric resistance of the carrier 1 used in a magnetic brush form was measured. The results are shown in FIG. 11. The electric resistance of the carrier 1 which was extrapolated at an electric field of $10^4$ V/cm was $1.8\times10^8$ Ωcm.

Carrier 2 (Used in Examples 3 and 4 and Comparative Examples 3 and 4)

| | |
|---|---|
| Ferrite (trade name: C28-FB, manufactured by Fuji Electrochemical Co., Ltd., average particle diameter: 50 μm) | 100 parts by weight |
| Toluene | 14 parts by weight |
| Styrene/methylmethacrylate copolymer (copolymerization ratio: 20:80, weight average molecular weight: 73,000) | 2 parts by weight |
| Stannic oxide-coated barium sulfate (Trade name: Pastlan TYPE-IV, manufactured by Mitsui Mining and Smelting Co., Ltd., electric resistance: 5 Ω cm, specific gravity: 5.6) (23.8% by volume of the resin coating layer) | 3.5 parts by weight |

The above components except for the ferrite were dispersed by using a sandmill for one hour to prepare a resin coating layer forming solution. The resin coating layer forming solution and the ferrite were placed in a vacuum degassing type kneader and stirred under reduced pressure at 60° C. for 20 minutes to form a resin coating layer on the ferrite, thereby obtaining a carrier 2. The thickness of the resin coating layer was 0.8 μm.

The electric resistance of the carrier 2 used in a magnetic brush form was measured. The electric resistance of the carrier 2 which was extrapolated at an electric field of $10^4$ V/cm was $2.1\times10^6$ Ωcm.

Carrier 3 (Used in Examples 5 and 6 and Comparative Examples 5 and 6)

| | |
|---|---|
| Iron powder (trade name: TSV, manufactured by Powdertech Co., Ltd., average particle diameter: 60 μm) | 100 parts by weight |
| Toluene | 8 parts by weight |
| Styrene/methylmethacrylate copolymer (copolymerization ratio: 20:80, weight average molecular weight: 73,000) | 1 part by weight |
| Carbon black (Trade name: VXC72, manufactured by Cabot, electric resistance: $10^{-1}$ Ω cm, specific gravity: 1.8) (10% by volume of the resin coating layer) | 0.2 parts by weight |

(10% by volume of the resin coating layer)

The above components except for the iron powder were dispersed by using a sandmill for one hour to prepare a resin coating layer forming solution. The resin coating layer forming solution and the iron powder were placed in a vacuum degassing type kneader and stirred under reduced pressure at 60° C. for 20 minutes to form a resin coating layer on the iron powder, thereby obtaining a carrier 3. The thickness of the resin coating layer was 0.8 μm.

The electric resistance of the carrier 3 used in a magnetic brush form was measured. The electric resistance of the carrier 3 which was extrapolated at an electric field of $10^4$ V/cm was $2.7\times10^3$ Ωcm.

Carrier 4 (Used in Examples 7 and 8 and Comparative Examples 7 and 8)

| | |
|---|---|
| Magnetite (trade name: MX030A, manufactured by Fuji Electrochemical Co., Ltd., average particle diameter: 50 μm) | 100 parts by weight |
| Toluene | 14.5 parts by weight |
| Styrene/methylmethacrylate copolymer (copolymerization ratio: 20:80, weight average molecular weight: 73,000) | 2 parts by weight |
| Carbon black (Trade name: VXC72, manufactured by Cabot, electric resistance: $10^{-1}$ Ω cm, specific gravity: 1.8) (14.3% by volume of the resin coating layer) | 0.6 parts by weight |

The above components except for the magnetite were dispersed by using a sandmill for one hour to prepare a resin coating layer forming solution. The resin coating layer forming solution and the magnetite were placed in a vacuum degassing type kneader and stirred under reduced pressure at 60° C. for 20 minutes to form a resin coating layer on the magnetite, thereby obtaining a carrier 4. The thickness of the resin coating layer was 0.8 μm.

The electric resistance of the carrier 4 used in a magnetic brush form was measured. The electric resistance of the carrier 4 which was extrapolated at an electric field of $10^4$ V/cm was $4.2\times10^0$ Ωcm.

In addition, the carriers described below were produced for Comparative Examples.

Carrier 5 (Used in Comparative Examples 9 to 12)

| | |
|---|---|
| Magnetite (trade name: MX030A, manufactured by Fuji Electrochemical Co., Ltd., average particle diameter: 50 μm) | 100 parts by weight |
| Toluene | 14.5 parts by weight |
| Styrene/methylmethacrylate copolymer (copolymerization ratio: 20:80, weight average molecular weight: 73,000) | 2 parts by weight |
| Carbon black (Trade name: VXC72, manufactured by Cabot, electric resistance: $10^{-1}$ Ω cm, specific gravity: 1.8) (2.2% by volume of the resin coating layer) | 0.08 parts by weight |

The resin was dissolved in toluene to form a resin coating layer forming solution, which was then placed together with the magnetite in a vacuum degassing type kneader and stirred under reduced pressure at 60° C. for 20 minutes to form a resin coating layer on the magnetite, thereby obtaining a carrier 5. The thickness of the resin coating layer was 0.8 μm. This carrier was observed by using a scan-type electron microscope, and as a result, it was confirmed that a uniform coating was formed without any exposed surface.

The electric resistance of the carrier 5 used in a magnetic brush form was measured. The electric resistance of the carrier 5 which was extrapolated at an electric field of $10^4$ V/cm was $6\times10^9$ Ωcm.

Carrier 6 (Used in Comparative Examples 13 to 16)

| | |
|---|---|
| Magnetite (trade name: MX030A, manufactured by Fuji Electrochemical Electrochemical Co., Ltd. average particle diameter: 50 $\mu$m) | 100 parts by weight |
| Toluene | 14.5 parts by weight |
| Styrene/methylmethacrylate copolymer (copolymerization ratio: 20:80, weight average molecular weight: 73,000) | 2 parts by weight |
| Carbon black (Trademark: VXC72, manufactured by Cabot, electric resistance: $10^{-1}$ Ω cm, specific gravity: 1.8) (14.3% by volume of the resin coating layer) | 0.6 parts by weight |

The above components except for the magnetite were dispersed by using a sandmill for one hour to prepare a resin coating layer forming solution. The resin coating layer forming solution and the magnetite were placed in a vacuum degassing type kneader and stirred under reduced pressure at 60° C. for 20 minutes to form a resin coating layer on the magnetite, thereby obtaining a carrier 6. The thickness of the resin coating layer was 0.8 $\mu$m.

The electric resistance of the carrier 6 used in a magnetic brush form was measured. The electric resistance of the carrier 6 which was extrapolated at an electric field of $10^4$ V/cm was $2\times10^{-1}1$ Ωcm.

Figure 12:
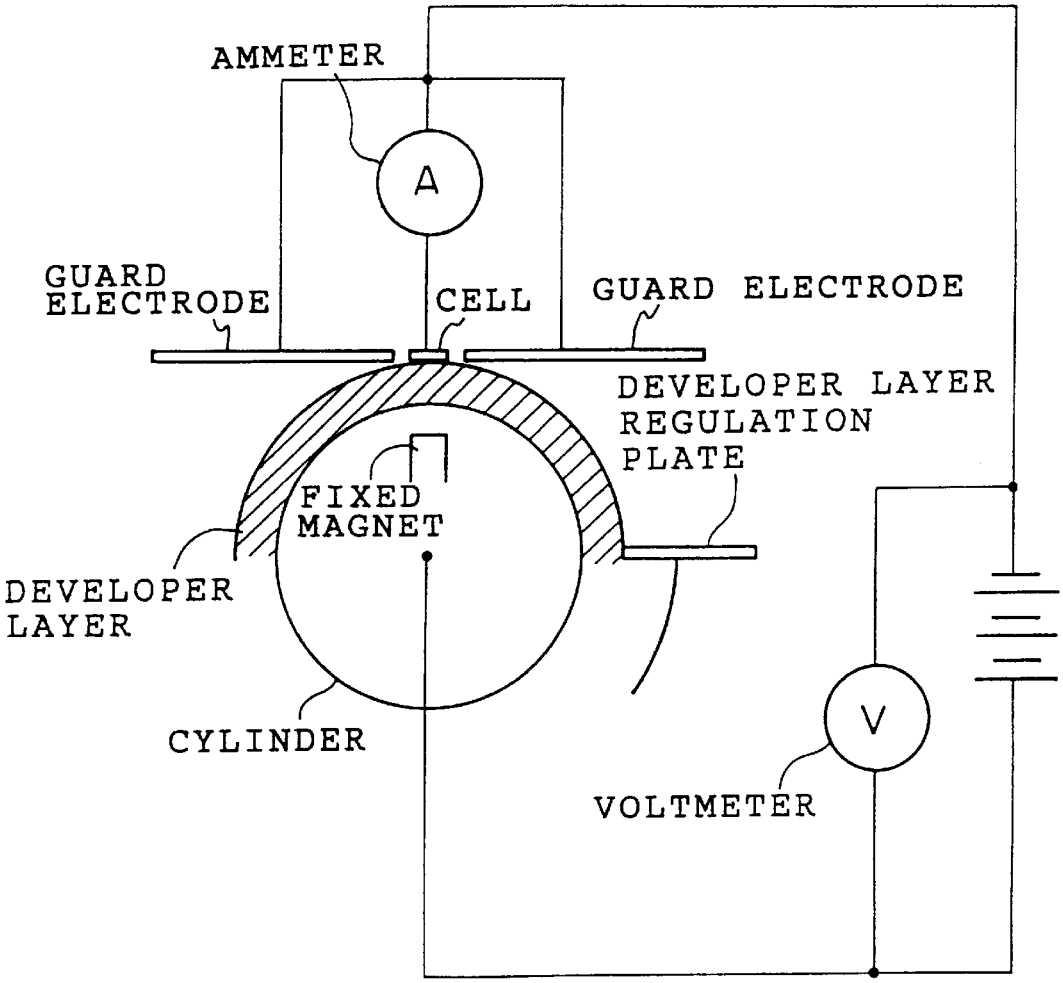
FIG. 12 is a schematic structural view showing a device for measuring electric resistance.

The electric resistances of the above carriers 1 to 6 were measured as follow:

As shown in FIG. 12, a cell was made to oppose, with an interval therebetween, a rotatable cylinder having a built-in fixed magnet. The electric resistance was calculated from a value of current flowing when a voltage was applied such that the intensity of the electric field was $10^4$ V/cm, and from the volume occupied by the portion of the developer which was opposed to the cell. Here, the size of the cell was 60 mm in the axial direction of the cylinder and 5 mm in the circumferential direction of the cylinder. The interval between the cell and the cylinder was 2.2 mm. The layer thickness of the developer was controlled such that the developer contacted the cell but there was no clogging of the developer between the cylinder and the cell when the cylinder was rotated. At this time, the weight of the carrier formed on the cylinder per unit area of the cylinder was 45 mg/cm$^2$.

II. Production of Toner

| | |
|---|---|
| Linear polyester resin (linear polyester prepared from terephthalic acid/bisphenol A ethylene oxide adduct/cyclohexane dimethanol, Tg: 62° C., Mn: 4,000, Mw: 12,000, acid value: 12, hydroxyl value: 25) | 100 parts by weight |
| Magenta Pigment (C.I. Pigment Red 57) | 4 parts by weight |

A mixture of the above components was kneaded in an extruder and pulverized by using an IDS crusher (manufactured by Nippon Pneumatic Co., Ltd.). The pulverized product was classified by using a TC-15 classifier (manufactured by Nisshin Engineering Co., Ltd.) to prepare magenta color particles having a volumetric average particle diameter $d_{50}$ of 7 $\mu$m. In addition, the following components were mixed by using a Henschel mixer to prepare a magenta toner used in the Examples and Comparative Examples.

| | |
|---|---|
| The prepared color particles | 100 parts by weight |
| Stannic oxide (average particle diameter: 0.2 $\mu$m, electric resistance: $10^2$ Ω cm) | 0.4 parts by weight |
| Titanium oxide (MT150W, manufactured by Teika Co., Ltd. | 1.2 parts by weight |
| R972 (manufactured by Japan Aerosil Co., Ltd.) | 0.7 parts by weight |

III. Production of Developer

Each of the carriers 1 to 6 and the magenta toner prepared in the above manner were mixed so that the proportion of the toner was as shown in Table 1-1 and Table 1-2, so as to manufacture the respective developers of Examples 1 to 8 and Comparative Examples 1 to 16.

TABLE 1-1

| Carrier Number | Resistance of carrier (Ω cm) ※ | Classification as Example/ Comparative Example | Proportion of toner in developer (% by weight) |
|---|---|---|---|
| Carrier 1 | $1.8 \times 10^3$ | Comparative Example 1 | 4 |
| | | Example 1 | 5 |
| | | Example 2 | 9 |
| | | Comparative Example 2 | 11 |
| Carrier 2 | $2.1 \times 10^5$ | Comparative Example 3 | 4 |
| | | Example 3 | 5 |
| | | Example 4 | 9 |
| | | Comparative Example 4 | 11 |
| Carrier 3 | $2.7 \times 10^3$ | Comparative Example 5 | 4 |
| | | Example 5 | 5 |
| | | Example 6 | 9 |
| | | Comparative Example 6 | 11 |
| Carrier 4 | $4.2 \times 10^0$ | Comparative Example 7 | 4 |
| | | Example 7 | 5 |

TABLE 1-2

| Carrier Number | Resistance of carrier (Ω cm) ※ | Classification as Example/ Comparative Example | Proportion of toner in developer (% by weight) |
|---|---|---|---|
| Carrier 4 | $4.2 \times 10^0$ | Example 8 | 9 |
| | | Comparative Example 8 | 11 |
| Carrier 5 | $6 \times 10^9$ | Comparative Example 9 | 4 |
| | | Comparative Example 10 | 5 |
| | | Comparative Example 11 | 9 |
| | | Comparative Example 12 | 11 |
| Carrier 6 | $2 \times 10^{-1}$ | Comparative Example 13 | 4 |
| | | Comparative Example 14 | 5 |

TABLE 1-2-continued

| Carrier Number | Resistance of carrier (Ω cm) ※ | Classification as Example/ Comparative Example | Proportion of toner in developer (% by weight) |
|---|---|---|---|
| | | Comparative Example 15 | 9 |
| | | Comparative Example 16 | 11 |

These developers were placed in the image forming device 10 shown in FIG. 3. The time constant of each of the developers of the Examples and Comparative Examples was measured to evaluate the saturated range of the developer and the brush marks.

The time constant of the developer was measured according to the above-described method. Other specific developing conditions and the evaluation method were as follows.

(Developing Conditions)

| | |
|---|---|
| Photorecepter | OPC (84 mm ϕ) |
| Processing speed | 160 mm/s |
| Charge potential at initial stage | −650 v |
| Potential of exposed portion | −200 v |
| ROS | LED (400 dpi) |
| Magnetic roll | 30 mm ϕ |
| Peak value of flux density in a radial direction | 100 mT |
| Speed of rotation | 336 mm/s |
| Interval (DRS) between the photorecepter and developer support member when the developing section 56 was opposed to the photorecepter | 0.5 mm |
| Environmental conditions | 22° C., 55% RH |

(Evaluation Method)

1. Saturated Region

The developing bias potential was varied successively. The cases where the saturated region were found and were not found in the developing curve showing the relation between the contrast potential and the amount of the developing toner are indicated as "○" and "×" respectively.

2. Brush Marks

A whole solid image of a size of 3×3 cm was copied and the resulting image was visually evaluated. A level in which there were clearly ten and several brush marks or more is indicated as "×", and only cases where there were fewer several or brush marks are indicated as "○".

The developing bias potential in the evaluations of the brush marks and carrier-over was applied to the magnetic roll 62 so that the amount of the developing toner provided saturated characteristics when the developer had a saturated region. Specifically, a DC-superimposed AC bias potential having a DC component of −500 V and an AC component (voltage between peaks) of 100 V (6 kHz) was used.

The evaluation results are shown in Tables 2-1, 2-2 and 2-3.

TABLE 2-1

| Carrier number | Classification as Example/ Comparative Example | Proportion of toner in Developer (% by weight) | Time constant of developer (msec) | Saturated characteristic | Brush marks |
|---|---|---|---|---|---|
| Carrier 1 | Comparative Example 1 | 4 | 24 | ○ | X |
| | Example 1 | 5 | 30 | ○ | ○ |
| | Example 2 | 9 | 38 | ○ | ○ |
| | Comparative Example 2 | 11 | 120 | X | ○ |
| Carrier 2 | Comparative Example 3 | 4 | 18 | ○ | X |
| | Example 3 | 5 | 26 | ○ | ○ |
| | Example 4 | 9 | 28 | ○ | ○ |
| | Comparative Example 4 | 11 | 73 | X | ○ |
| Carrier 3 | Comparative Example 5 | 4 | 7 | ○ | X |
| | Example 5 | 5 | 12 | ○ | ○ |
| | Example 6 | 9 | 23 | ○ | ○ |
| | Comparative Example 6 | 11 | 60 | X | ○ |

TABLE 2-2

| Carrier number | Classification as Example/ Comparative Example | Proportion of toner in Developer (% by weight) | Time constant of developer (msec) | Saturated character -ristic | Brush marks |
|---|---|---|---|---|---|
| Carrier 4 | Comparative Example 7 | 4 | 0.3 | ○ | X |
| | Example 7 | 5 | 1 | ○ | ○ |
| | Example 8 | 9 | 18 | ○ | ○ |
| | Comparative Example 8 | 11 | 50 | X | ○ |
| Carrier 5 | Comparative Example 9 | 4 | 60 | X | ○ |
| | Comparative Example 10 | 5 | 120 | X | ○ |
| | Comparative Example 11 | 9 | 300 | X | ○ |
| | Comparative Example 12 | 11 | 600 | X | ○ |
| Carrier 6 | Comparative Example 13 | 4 | 0.1 | ○ | X |
| | Comparative Example 14 | 5 | 0.5 | ○ | X |

TABLE 2-3

| Carrier number | Classification as Example/ Comparative Example | Proportion of toner in Developer (% by weight) | Time constant of developer (msec) | Saturated character -ristic | Brush marks |
|---|---|---|---|---|---|
| Carrier 6 | Comparative Example 15 | 9 | 4 | ○ | X |
| | Comparative Example 16 | 11 | 42 | X | ○ |

As is understood from Tables 2-1, 2-2 and 2-3, when the developers of Examples 1 to 8 were used, highly-saturated solid regions were obtained and no brush marks could be seen. On the other hand, when the developers of Comparative Examples 1 to 16 were used, there were brush marks or no saturated regions of the developer were obtained.

What is claimed is:

1. An image forming method comprising an exposure step of effecting exposure on the basis of image data to form an electrostatic latent image on a latent image support member which is uniformly charged, and a developing step of developing the electrostatic latent image by using a developer on a developer support member to make the electrostatic latent image visible, wherein the developer comprises a magnetic carrier and a toner;

a developing curve of the developer at the time when the developer is used has a saturated characteristic, the developing curve being an expression of the relation between the amount of toner transferred to the latent image support member and contrast potential, the contrast potential being determined by the developing bias potential applied to the developer support member and the potential of an exposed portion of the latent image support member;

the proportion of the toner in the developer is in a range from 5 to 10% by weight;

the time constant of the developer is less than or equal to 40 msec; and the developing step comprises applying a developing bias voltage to the developer support member such that the amount of the toner transferred to the latent image support member reaches a saturated range.

2. An image forming method according to claim 1, wherein the magnetic carrier is produced by coating a core material with a resin coating layer.

3. An image forming method according to claim 2, wherein the film thickness of the resin coating layer is 0.1 to 5 $\mu$m.

4. An image forming method according to claim 1, wherein the volumetric average particle diameter of the magnetic carrier is 10 to 100 $\mu$m.

5. An image forming method according to claim 2, wherein the core material is a ferrite.

6. An image forming method according to claim 2, wherein the resin coating layer contains an electroconductive powder.

7. An image forming method according to claim 6, wherein the electric resistance of the electroconductive powder is less than or equal to $1\times10^6$ Ωcm.

8. An image forming method according to claim 6, wherein the electroconductive powder is contained in an amount of 3 to 50% by volume based on the resin coating layer.

9. An image forming method according to claim 1, wherein the toner comprises an inorganic micropowder having an electric resistance of $1\times10^6$ Ωcm or less.

10. An image forming method according to claim 1, wherein the developing bias potential uses a developing bias obtained superimposing an alternating electric field, whose voltage between peaks is 100 to 500 V and whose frequency is 400 Hz to 20 kHz, on a DC electric field.

11. An image forming method according to claim 1, wherein the latent image contrast potential at the time that the latent image on the latent image support member is exposed at an input image area ratio of 50% is 90% or more of the latent image contrast potential formed by the potential of the charged latent image support member and the surface potential at the time that the latent image is exposed at the input image area ratio of 100%.

12. An image forming device comprising an exposure means for effecting the exposure on the basis of image data to form an electrostatic latent image on a latent image support member which is uniformly charged, and a developing means for developing the electrostatic latent image by using a developer on a developer support member to make the electrostatic latent image visible, the developer comprising a magnetic carrier and a toner, wherein a developing curve of the developer at the time when the developer is used has a saturated characteristic, the developing curve being an expression of the relation between the amount of toner transferred to the latent image support member and contrast potential, the contrast potential being determined by the developing bias potential applied to the developer support member and the potential of an exposed portion of the latent image support member;

the proportion of the toner in the developer is in a range from 5 to 10% by weight;

the time constant of the developer is less than or equal to 40 msec; and the developing step comprises applying developing bias voltage to the developer support member such that the amount of the toner transferred to the latent image support member reaches a saturated range.

13. An electrostatic latent image developer comprising a magnetic carrier and a toner, wherein the proportion of the toner in the electrostatic latent image developer is in a range from 5 to 10% by weight and the time constant of the developer is less than or equal to 40 msec.

14. An electrostatic latent image developer according to claim 13, wherein the toner contains an inorganic micropowder with an electric resistance of $1\times10^6$ Ωcm or less.

* * * * *